US005934993A

United States Patent [19]

Maruyama

[11] Patent Number: 5,934,993

[45] Date of Patent: Aug. 10, 1999

[54] AERATION STRUCTURE IN BUILDINGS

[76] Inventor: Noboru Maruyama, 2-26-14 Shirasagi, Nakano-ku, Tokyo, Japan

[21] Appl. No.: 08/852,398

[22] Filed: May 7, 1997

[30] Foreign Application Priority Data

May 10, 1996 [JP] Japan ..... 8-140633

[51] Int. Cl.[6] ..... F23J 11/00; E04H 12/28

[52] U.S. Cl. ..... 454/250; 454/237

[58] Field of Search ..... 454/8, 237, 242, 454/250, 253, 2

[56] References Cited

U.S. PATENT DOCUMENTS

| | | | |
|---|---|---|---|
| 20,909 | 7/1858 | Webster | 454/2 |
| 61,820 | 2/1867 | Estes | 454/250 |
| 99,722 | 2/1870 | Somes | 454/237 X |
| 424,778 | 4/1890 | Gee | 454/237 |
| 1,207,855 | 12/1916 | Cantwell | 454/250 X |
| 1,689,246 | 10/1928 | Knapen | 454/250 |
| 1,690,905 | 11/1928 | McDevitt et al. | 454/250 |
| 5,447,470 | 9/1995 | Zaniewski | 454/250 X |

FOREIGN PATENT DOCUMENTS

| | | | |
|---|---|---|---|
| 725730 | 5/1932 | France | 454/237 |
| 5014 | 3/1896 | United Kingdom | 454/8 |

*Primary Examiner*—Harold Joyce
*Attorney, Agent, or Firm*—Kuffner & Associates

[57] ABSTRACT

Aeration system for a multi-storied building 10 having living space 11 on each floor, wherein an air supply hole for letting in outdoor air is located in a lower section of the living space, and an air exhaust hole is located in an upper section of the living space. An air supply path and an air exhaust path are connected to the air supply hole and air exhaust hole of each living space. Said air supply path and said air exhaust path extend in opposite vertical directions. All holes and paths in their said locations and directions respectively are provided on each floor.

8 Claims, 11 Drawing Sheets

AERATION STRUCTURE IN BUILDINGS

BACKGROUND OF THE INVENTION

The present invention relates to an aeration structure for buildings. More specifically, the invention relates to an aeration structure which makes use of natural air flow based on heat generated in a room space, as by persons living or working in the room.

In recent years, the degree to which buildings are airtight has increased. At the same time, the demand for aeration and ventilation to introduce fresh air into a living space has become stronger. Generally electric or mechanical energy is used for aeration and ventilation as well as control thereof. The use of electric or mechanical energy causes high energy consumption despite the desire for energy savings.

Further, in cases of natural disasters such as earthquakes, power to the aeration and ventilation systems can go down. Lack of aeration and ventilation created in this circumstance is a risk to human life because oxygen deficiency may result. Also, if a fire occurs after the power is stopped in a highly airtight space, smoke may fill the living spaces, endangering lives, because the systems for discharging the smoke are not operational.

PRINCIPLE OF THE INVENTION

As shown in FIG. 1, air supply hole 2, located in a lower section of living space 1, opens to the outside. Air exhaust hole 3, located at a height difference H from air supply hole 3, is located in an upper section of the living space 1. Herein, assuming that a specific weight(or, density) of outdoor air is $\tau_d$, that temperature of the outdoor air is $T_d$, that specific weight of indoor air is $\tau_r$, and that temperature of indoor air is $T_r$, a draft force $P_{ch}$ generated in living space 1 is expressed by the following expression (1):

$$P_{ch}=H\cdot(\tau_d-\tau_r) \tag{1}$$

Herein, assuming that air pressure is P, that specific volume is V, and that a gas constant is R, an equation for the gas is expressed by PV=RT, and also as $V=1/\tau$. The (1) expression can be rewritten into the following expression (2):

$$P_{ch}=P_oH/R\cdot(1/T_d-1/T_r). \tag{2}$$

$P_o$ in this expression indicates an atmospheric pressure.

Because of body temperature or various devices in a room generating heat, heat can accumulate in living space 1. In this situation, $T_d$ becomes lower than $T_r$ ($T_d<T_r$). As a result, $P_{ch}$ becomes larger than zero ($P_{ch}>0$) in expression (2), and a draft flow power as indicated by the arrow mark in FIG. 1 is generated in the living space. The outdoor air flows into the living space through air supply hole 2 and is released from the room through air exhaust hole 3. It should be noted that, as temperature increases with volume expanding in living space 1, the cross-sectional area of air exhaust hole 3 must be larger than that of air supply hole 2 in order to accommodate an equal mass.

Also, as shown in FIG. 2, in a generally U-shaped air path comprising vertical paths 4 a $P_{ch}$ d 5 and horizontal path 6, assuming that the specific weight of the air in vertical path 4 is $\tau_d$, that temperature of the air is $T_d$, that specific weight of the air in vertical path 5 is $\tau_u$, and that temperature of the air is $T_u$, a draft power $P_{ch}$ of air flowing through the path indicated by points a, b, c and d is expressed by the following expression (3), like in the case of expression (1):

$$P_{ch}=H\cdot(T_d-\tau_u) \tag{3}$$

And, also like in the case of expression (2), the expression (3) can be rewritten into the following expression (4):

$$P_{ch}=P_oH/R\cdot(1/T_d-1/T_u) \tag{4}$$

In expression (4), if $T_d$ is equal to $T_u$ ($T_d=T_u$), Pch becomes zero ($P_{ch}=0$), so that a draft power is not generated.

Herein it is assumed that living space 1 shown in FIG. 1 is located in horizontal section 6 of the U-shaped aeration path shown in FIG. 2. Air supply hole 2 opens to the side of vertical path 4, and air exhaust hole 3 opens to the side of vertical path 5. As described above, heat is generated inside living space 1. Because of the heat, an air flow is generated in which air in vertical path 4 flows through air supply hole 2 into living space 1, becomes heated and the heated air is released through air exhaust hole 3 into vertical path 5. To reflect this result in expression (4), $T_d$ becomes lower than $T_u$ ($T_d<T_u$ ($=T_r$)); namely, Pch becomes larger than zero ($P_{ch}>0$). A draft power is generated causing air flow from point a to points b and c and then to point d.

The inventor of the present invention paid special attention to generation of natural draft power due to generation of heat inside a living space, as described above. The inventor completed the present invention based on this finding.

SUMMARY OF THE INVENTION

The present invention was made in the light of the technological findings described above, and achieves the objectives described below.

One object of the present invention is to provide, in highly airtight buildings, an energy-saving aeration and ventilation system.

Another object of the present invention is to provide an aeration system for buildings which would not cease during a natural disaster, even if power to the structure ceased.

A different object of the present invention is to provide an aeration system for buildings in which air paths and components are shared in various applications.

Still another object of the present invention is to provide an aeration system for buildings which would allow reduction of concrete spans, simplifying the structure and increasing the anti-seismic capabilities of each building.

According to the present invention, these objectives are achieved by an aeration system having an air supply port for introducing outdoor air into a lower section of a living space and an air exhaust port in an upper section of the living space, at a height above the air supply port, for exhausting air from the living space.

The present invention provides an aeration system for multi-storied buildings having at least one living space on each floor. For this purpose, the aeration system includes a unitary structure that has a supply hole in a lower section in each living space for introducing outdoor air, an exhaust hole in an upper section of each living space, for exhausting inside air, and air supply paths and air exhaust paths each extending in opposite vertical directions and each being connected to the air supply hole as well as to the air exhaust path of each living space in each floor of the building.

The present invention is further characterized in that the air supply path and air exhaust path are each formed outside the frame of the building and at least a portion of the air supply path and the air exhaust path extends through each of the living spaces on each floor inside the frame of the building.

In one preferred embodiment of the present invention the air supply path and air exhaust paths partition a double cylinder comprising an internal and an external cylinder, and an exhaust fan is provided at an exit section of the air exhaust path. In this embodiment, the external cylinder may be supported by a connecting span between the external cylinder and each structural support in the frame of the building. Cylindrical structural supports may be arranged along the external periphery of the external cylinder to provide additional structural integrity. Connecting span members may also be provided between a structural support and an adjacent pole in the building frame. In this manner, various types of piping for equipment can be located in a space between the external cylinder and the structural support.

An additional useful embodiment of the present invention is characterized in that it has a rain water gathering section for collecting and holding rainwater. This section is formed in a roof portion of the building frame with the internal and external cylinders of the aeration system structure projecting into the water gathering section. A rain water pipe opening into the water gathering section is accommodated in the air exhaust path.

DESCRIPTION OF THE PREFERRED EMBODIMENTS

Figure 3:
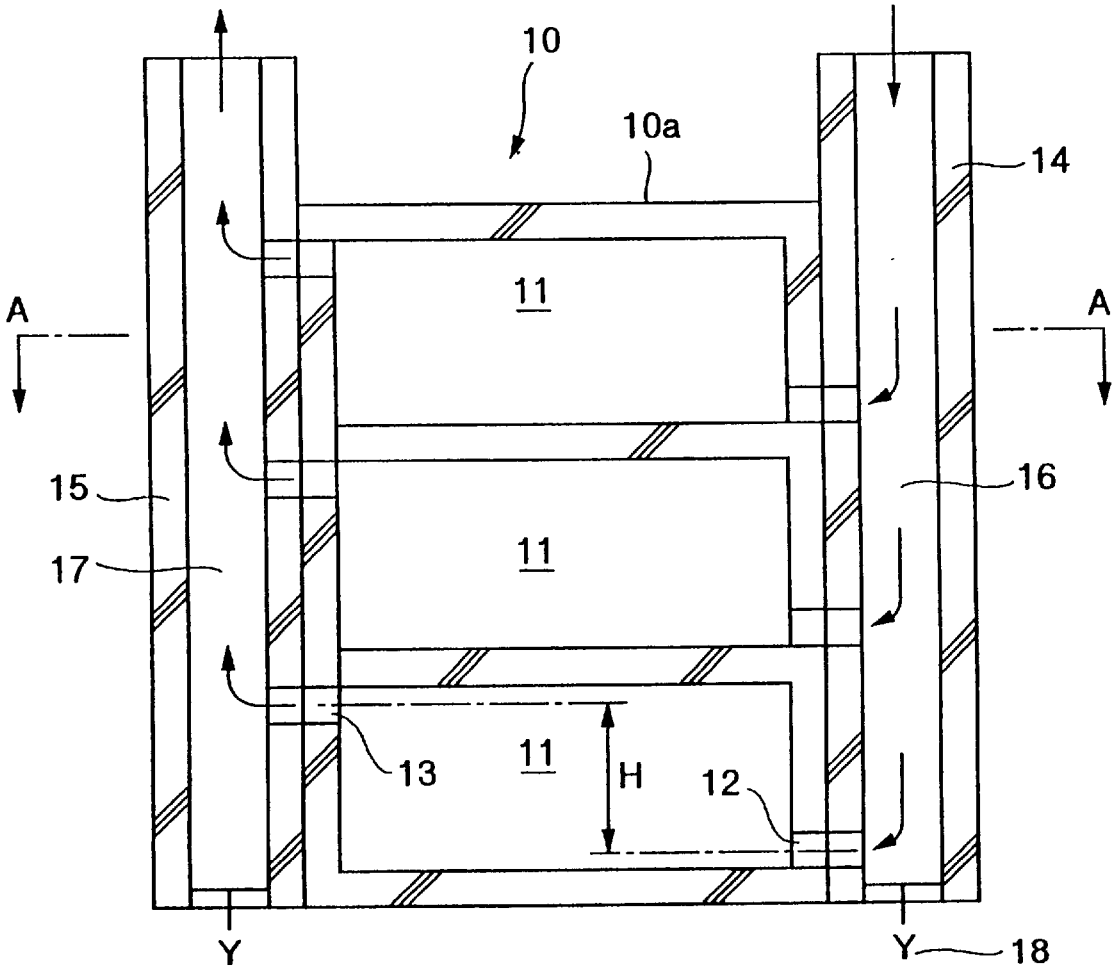
FIG. 3 is a cross-sectional view showing the first embodiment of the present invention.
Figure 4:
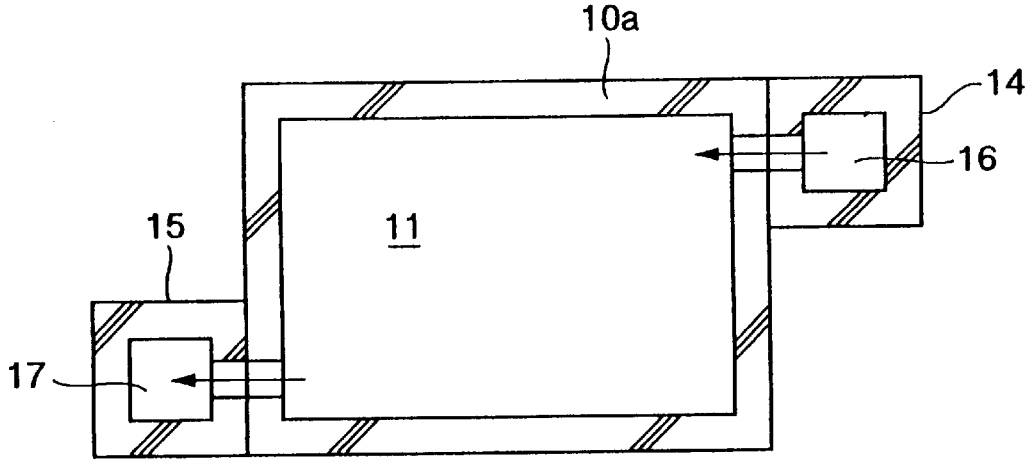
FIG. 4 is a cross-sectional view taken along line A of FIG. 3.

A detailed description of preferred embodiments of the present invention will next be set forth with reference to the accompanying drawings. In the drawings, FIG. 3 and FIG. 4 show the first embodiment of the present invention. In this embodiment, building 10 is a concrete, multi-level structure with at least one living space 11 on each floor. Air supply hole 12 is provided in a lower section of each living space and air exhaust hole 13 is located in an upper section of each living space at a height difference H from air supply hole 12. In this embodiment, air supply hole 12 and air exhaust hole 13 are provided on opposite walls of the same room.

Air supply conduit 14 and air exhaust conduit 15 are located on opposite external sides of building 10. Both conduits 14 and 15 are ducts having a rectangular cross section and are made from concrete. Air supply duct 14 helps create air supply path 16. Air exhaust duct 15 helps create air exhaust path 17. Air supply path 16 and air exhaust path 17 are connected to air supply hole 12 and to air exhaust hole 13 in each living space on each floor. The relation between cross-sectional area $F_0$ of air supply path 16 and cross-sectional area $F_1$ of air exhaust path 17 is expressed by the expression: $F_1 \geqq F_0$. The relation is applicable in each of the embodiments described below.

In FIG. 3, the reference numeral 18 indicates a water drain.

Figure 1:
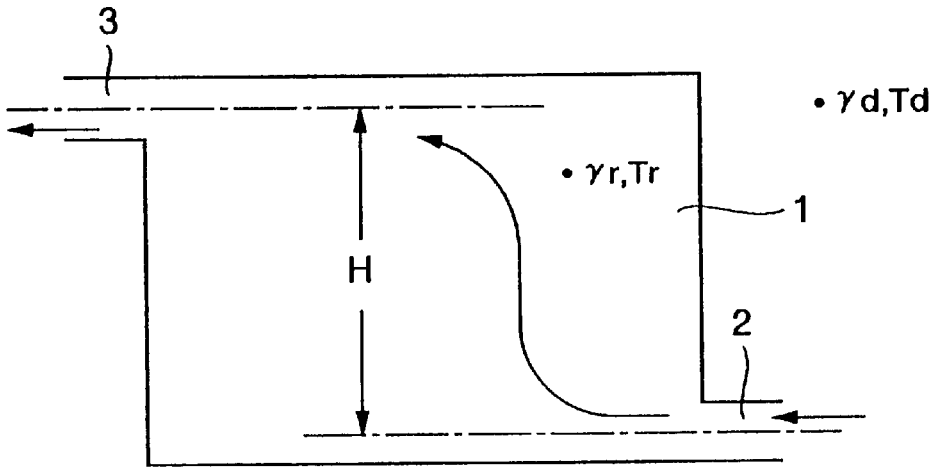
FIG. 1 is an explanatory view of the principles of the present invention.
Figure 2:
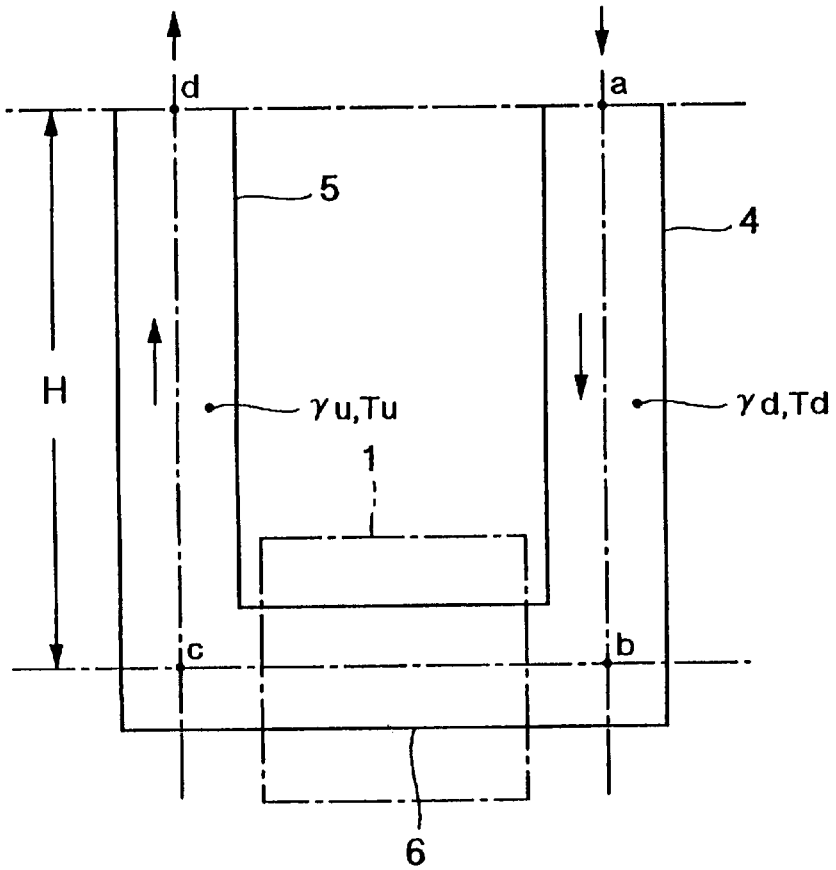
FIG. 2 is an additional explanatory view of the principles of the present invention.

In this embodiment, as explained in relation to FIGS. 1 and 2, natural aeration is generated when outdoor air flows into the air supply path 16, through air supply hole 12 into living space 11, becomes warm through heat exchange and then is released through air exhaust hole 13 and air exhaust path 17.

Figure 5:
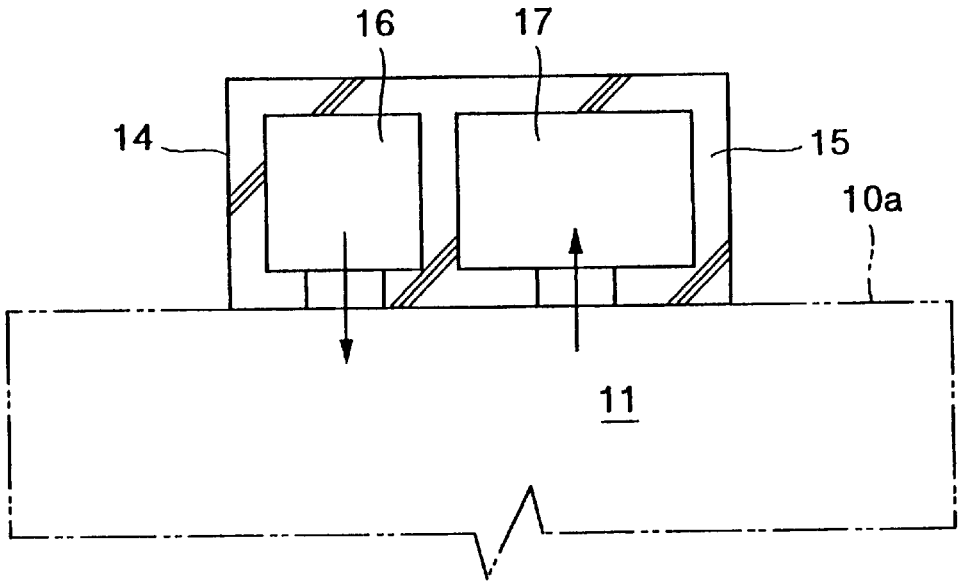
FIG. 5 is a horizontal cross-sectional view showing a second embodiment of the present invention.

FIG. 5 shows a second embodiment of the present invention. In this embodiment, air supply conduit 14 and air exhaust conduit 15 are also rectangular ducts and are parallel to each other in the same external surface of frame 10*a*.

Figure 6:
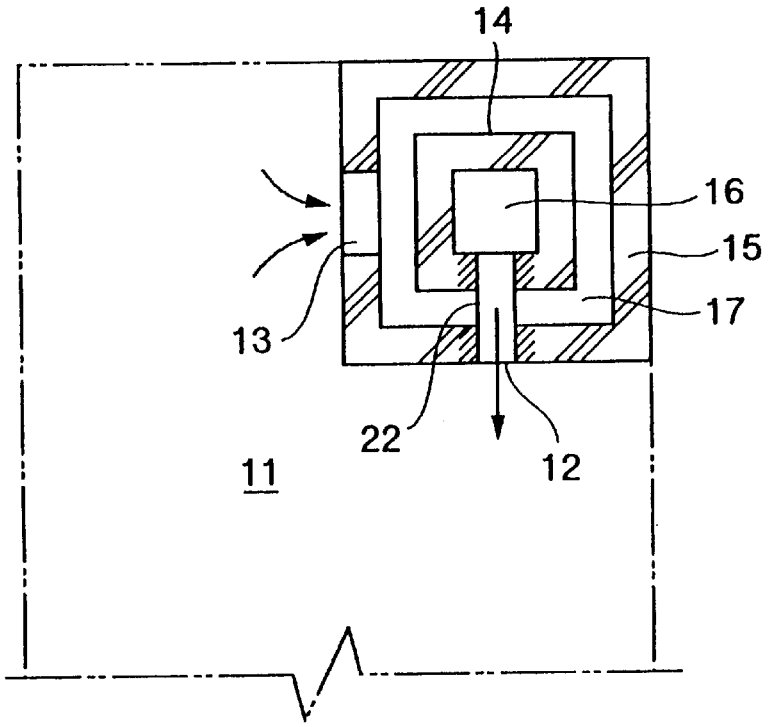
FIG. 6 is a horizontal cross-sectional view showing a third embodiment of the present embodiment.

FIG. 6 shows a third embodiment of the present invention. In this embodiment, the air supply conduit 14 is internal and the air exhaust conduit 15 is external to a double cylinder structure extending through each living space 11 on each floor. Air exhaust path 17 is located between air supply cylinder 14 and air exhaust cylinder 15. Air supply hole 12 and air exhaust hole 13 are located in air exhaust cylinder 15, as shown. Air supply hole 12 and air supply path 16 are connected to each other through pipe 22. Air supply cylinder 14 and air exhaust cylinder 15, constituting a double cylinder, may be located outside the building frame 10*a*, as discussed above.

Figure 7:
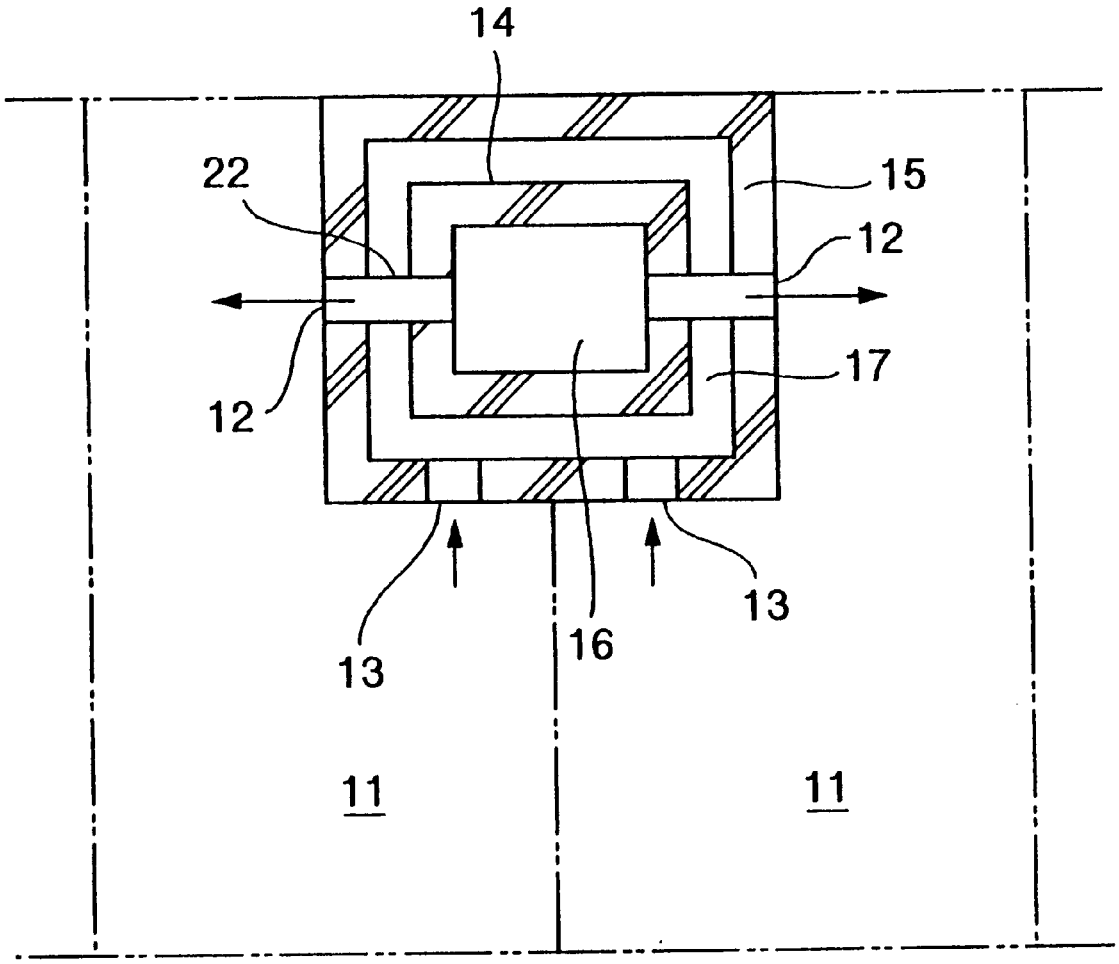
FIG. 7 is a horizontal cross-sectional view showing a fourth embodiment of the present invention.

FIG. 7 shows a fourth embodiment of the present invention. In this embodiment, air supply cylinder 14 and air exhaust cylinder 15 each also have a rectangular cross section. Each are made from concrete and extend through the two living spaces adjoining each other. The cylinders thus occupy a portion of each of the adjoining living spaces on each floor and the air supply path 16 and air exhaust path 17 are shared by the two living spaces.

Figure 8:
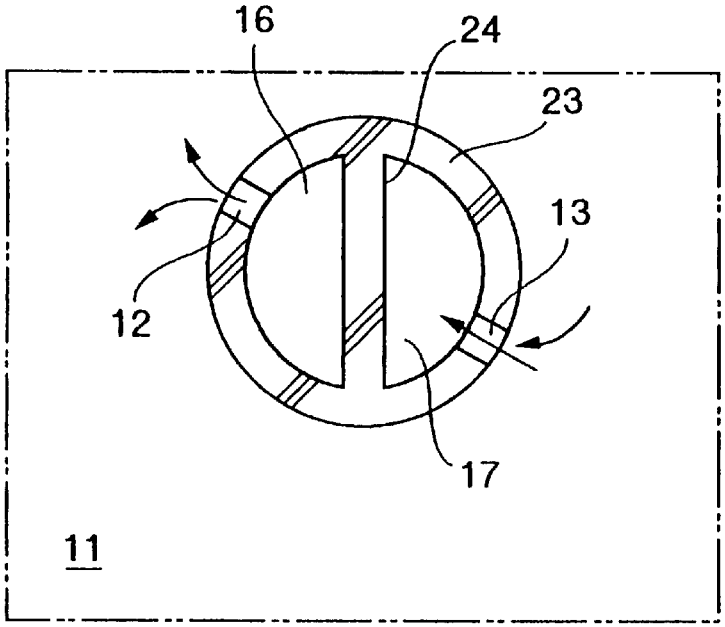
FIG. 8 is a horizontal cross-sectional view showing a fifth embodiment of the present invention.

FIG. 8 shows a fifth embodiment of the present invention. In this embodiment, air supply/exhaust cylinder 23 has a round cross section extending into each living space 11 on each floor. Air supply/exhaust cylinder 23 is partitioned into air supply path 16 and air exhaust path 17 by partitioning body 24.

Figure 9:
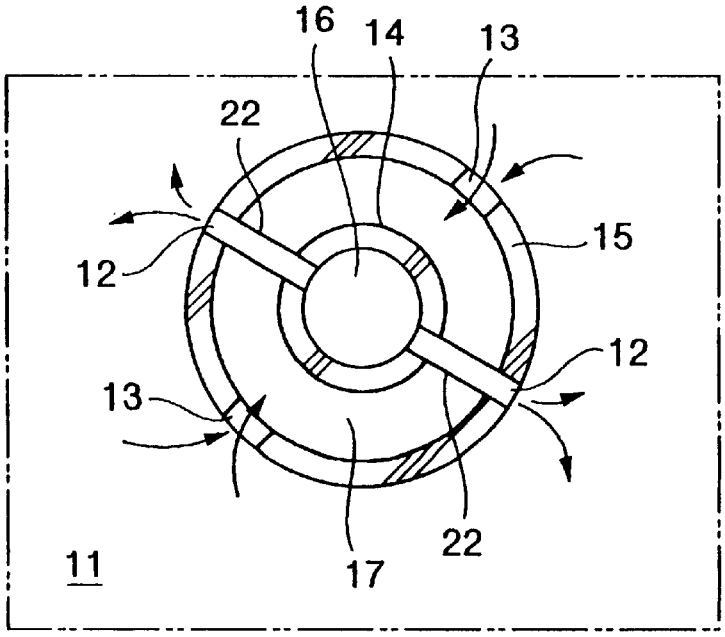
FIG. 9 is a horizontal cross-sectional view showing a sixth embodiment of the present invention.

FIG. 9 shows a sixth embodiment of the present invention. In this embodiment, air supply cylinder 14 and air exhaust cylinder 15 constitute a double cylinder having a round cross section. Air supply cylinder 14 and air exhaust cylinder 15 extend through each living space 11 on each floor. A plurality of air supply holes 12 and air exhaust holes 13 are located in air exhaust cylinder 15. Air supply holes 12 and the air supply path are connected to each other through pipe 22.

Figure 10:
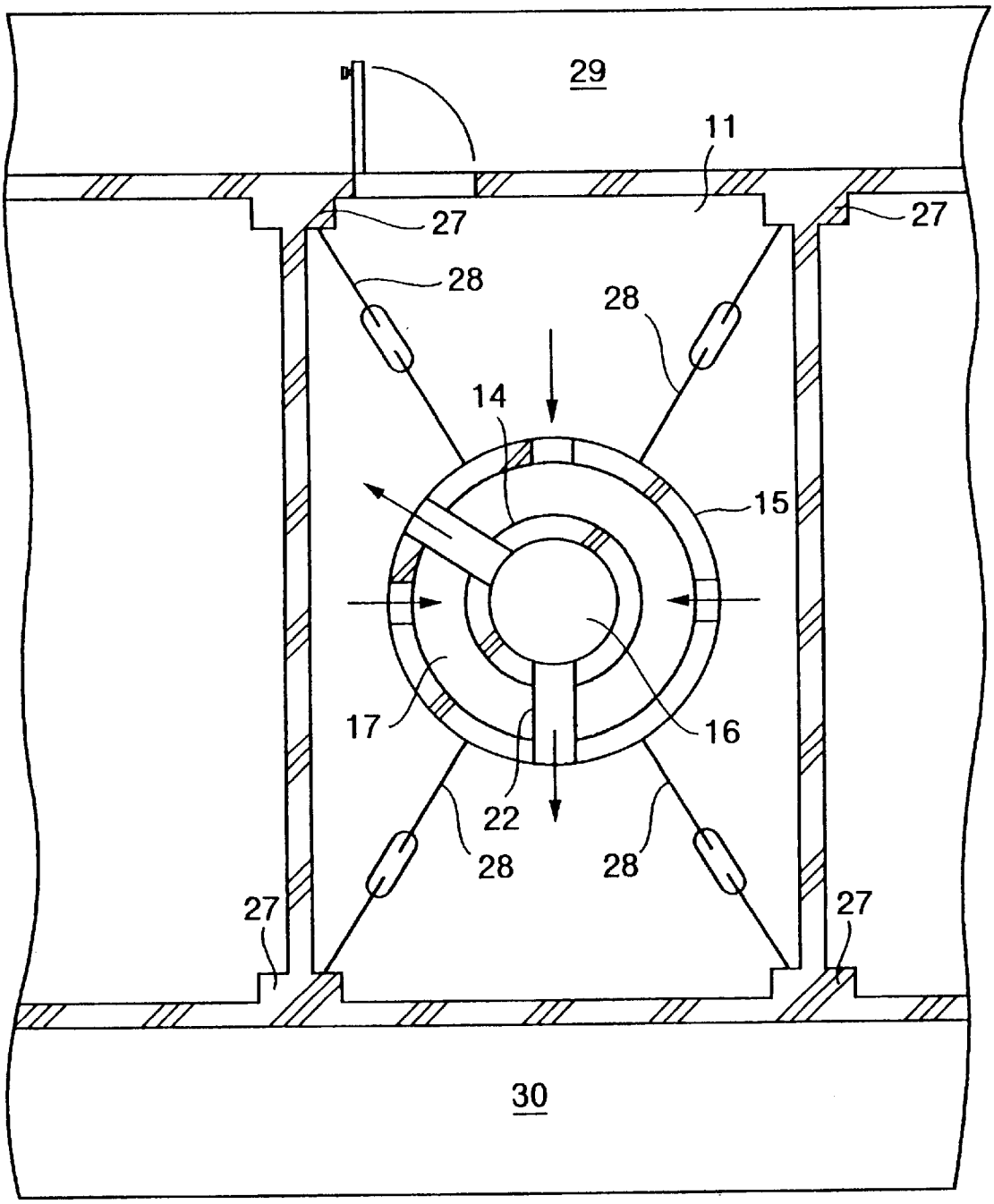
FIG. 10 is a horizontal cross-sectional view showing a seventh embodiment of the present invention.

FIG. 10 shows a seventh embodiment of the present invention. In this embodiment, additional components are added to the sixth embodiment. Namely, air supply cylinder 14 and air exhaust cylinder 15 extend substantially into a central portion of the living space. Span member 28 connects the air exhaust cylinder 15 and pole 27 in frame 10*a*. Span member 28 is made from a turnbuckle, but may be made with concrete.

In this embodiment, exhaust cylinder 15 and the span member form a monolithic body that also functions as support for the building. It should be noted that, in FIG. 10, the reference numeral 29 indicates a public corridor and the reference numeral 30 indicates a veranda.

Figure 11:
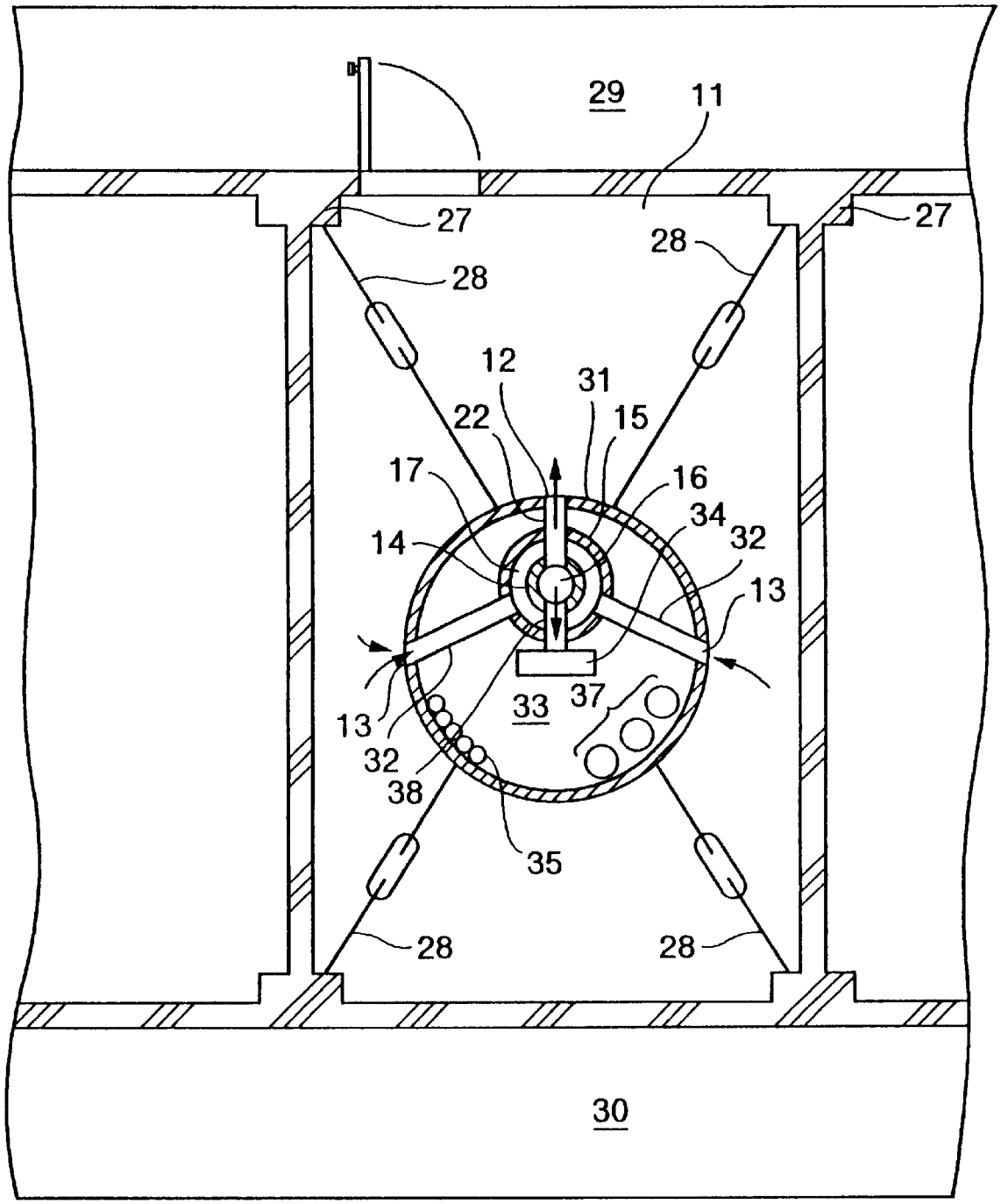
FIG. 11 is a horizontal cross-sectional view showing an eighth embodiment of the present invention.

FIG. 11 indicates an eighth embodiment of the present invention. In this embodiment, additional components are added to the seventh embodiment. Namely, pipe shaft 31 is added along the external peripheral of air supply/exhaust cylinders 14 and 15. Air supply path 16 and air exhaust path 17 are partitioned from each other so that a triple cylinder is formed as a whole. The air supply/exhaust cylinders 12 and 13 and pipe shaft 31 are made from copper. Air supply hole 12 and air exhaust hole 13 are located in pipe shaft 31. Air supply hole 12 and air supply path 16 are connected to each other through pipe 22.

Span member 28 connects pipe shaft 31 and pole 27. Pipe shaft 31 functions as structural support and also as a space for accommodating various types of equipment and piping for the equipment. Namely located in space 33 formed between pipe shaft 31 and air exhaust cylinder 15 are hot water supplier 34, cooling medium pipe 35 for the air conditioner, and pipe 37. Pipe 37 can be a gas pipe, water pipe or drainage pipe. In a case in which hot water supplier 34 is based on a combustion system, hot water supplier 34 is connected through pipe 38 to air exhaust 17.

Figure 12:
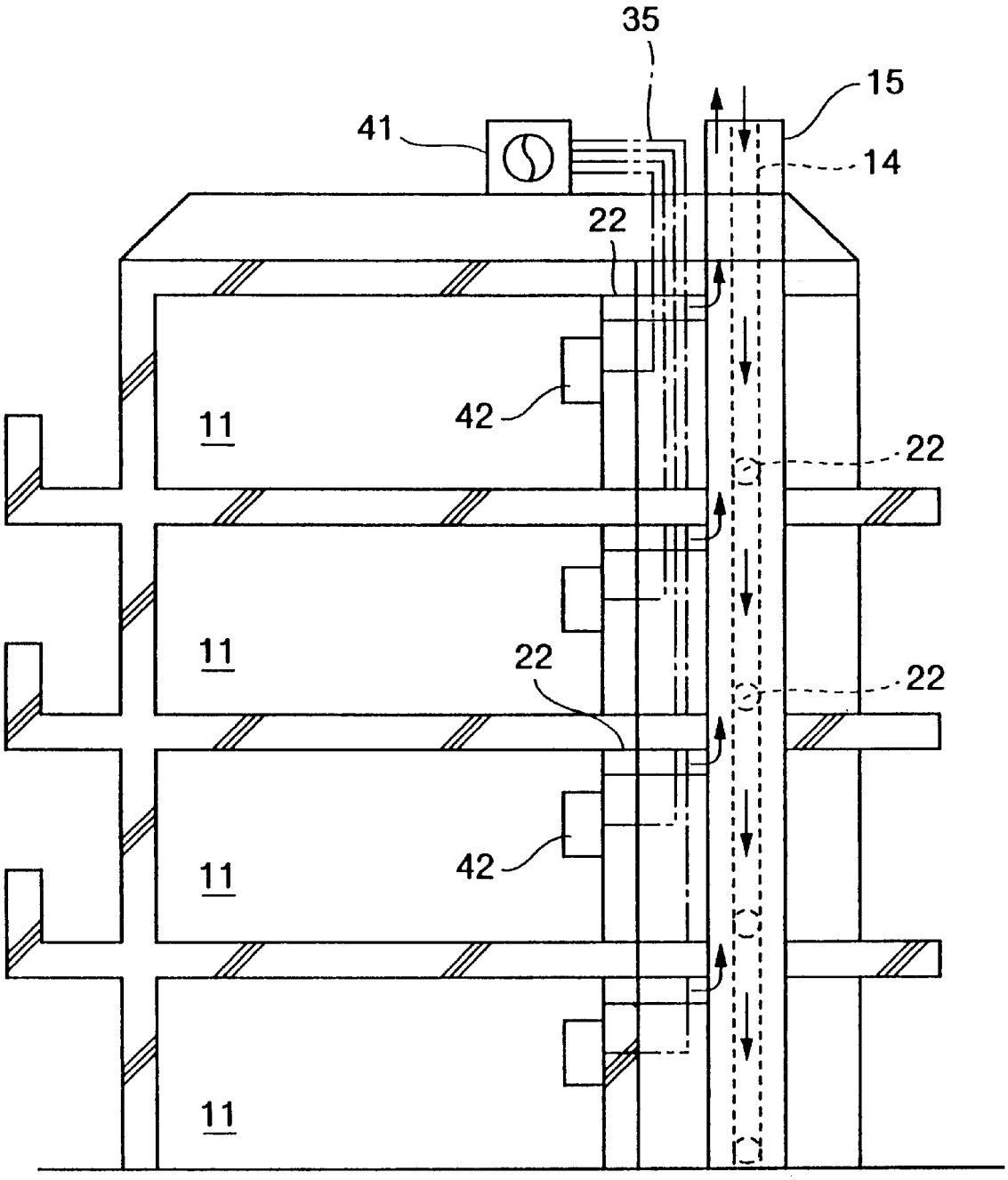
FIG. 12 is a horizontal cross-sectional view showing a ninth embodiment of the present invention.
Figure 13:
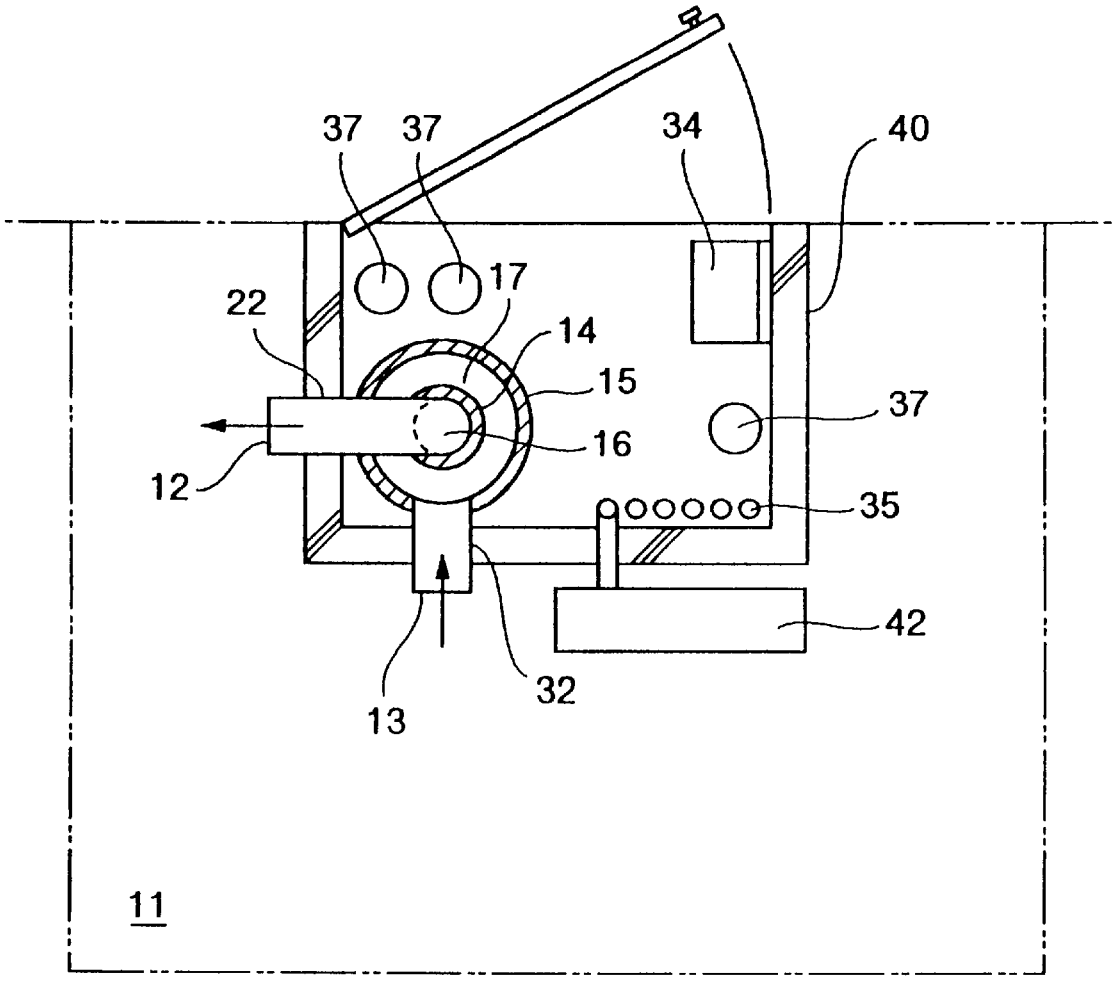
FIG. 13 is a horizontal cross-sectional view showing the same.

FIGS. 12 and 13 show a ninth embodiment of the present invention. In this embodiment, the air supply/exhaust cylinders 14 and 15, hot water supplier 34, cooling medium pipe 35, and pipe 37 are located in meter box 40 formed within living space 11. Like the eighth embodiment, air supply hole 12 and air supply path 16 are connected to each other through pipe 22. Air exhaust hole 13 and air exhaust path 17 are connected to each other through pipe 32. It should be noted that, in FIG. 12, the reference numeral 41 indicates the outdoor portion of an air conditioning system and, in both FIG. 12 and FIG. 13, the reference numeral 42 indicates an indoor portion of an air conditioner.

Figure 14:
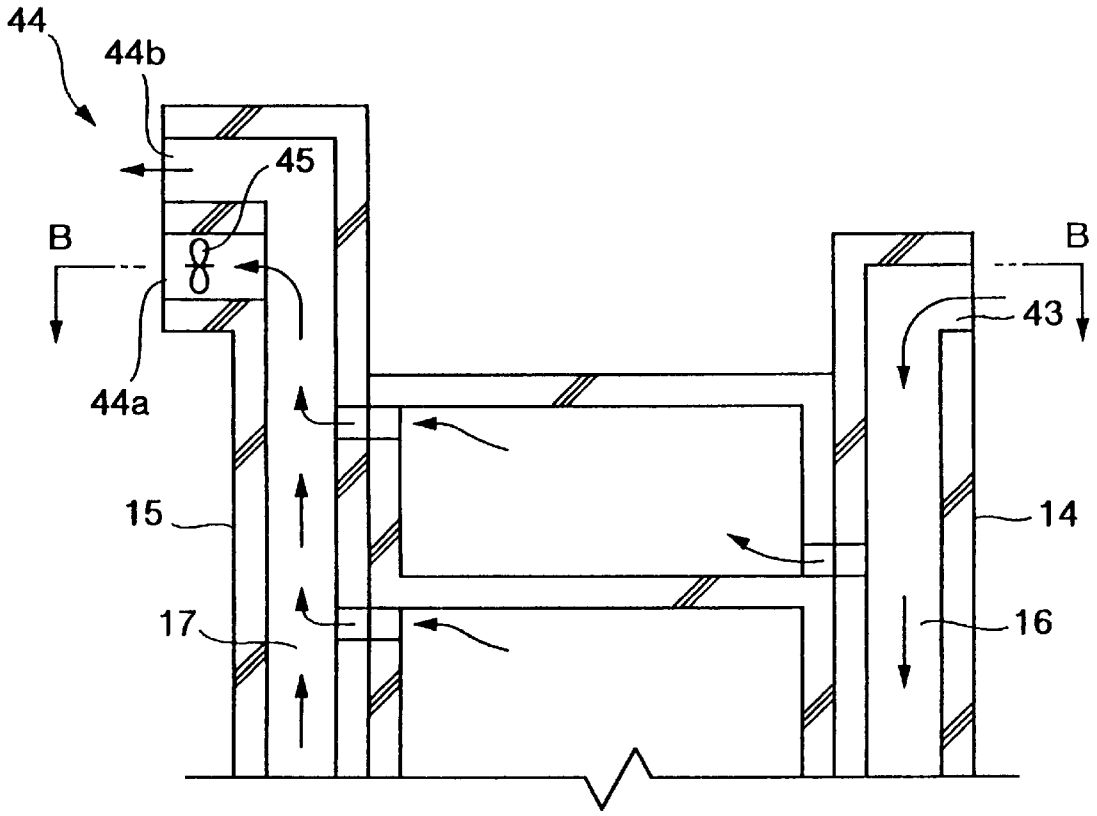
FIG. 14 is a horizontal cross-sectional view showing a tenth embodiment of the present invention.
Figure 15:
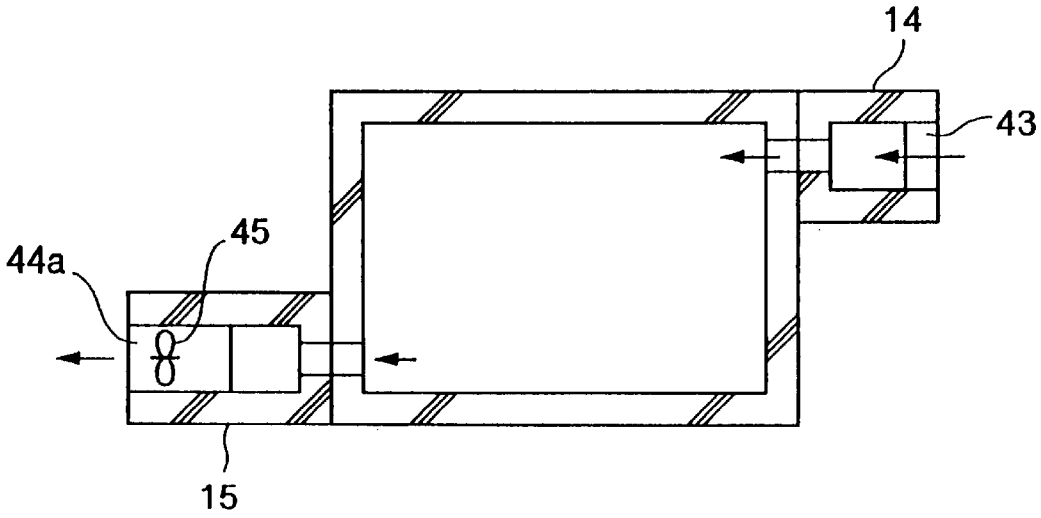
FIG. 15 is a cross-sectional view showing the line B—B of FIG. 14.

FIG. 14 and FIG. 15 show a tenth embodiment of the present invention. In this embodiment, additional components are added to the first embodiment of the present invention. Entrance 43 of air supply path 16 and exit 44 of air exhaust path 17 face sidewards. Exit 44 of the air exhaust path 17 consists of two exits 44*a* and 44*b*. Forcible air exhaustion is executed through exit 44*a* by air exhaust fan 45, but, during power failure, air exhaustion is executed from the other exit, 44*b*.

Figure 16:
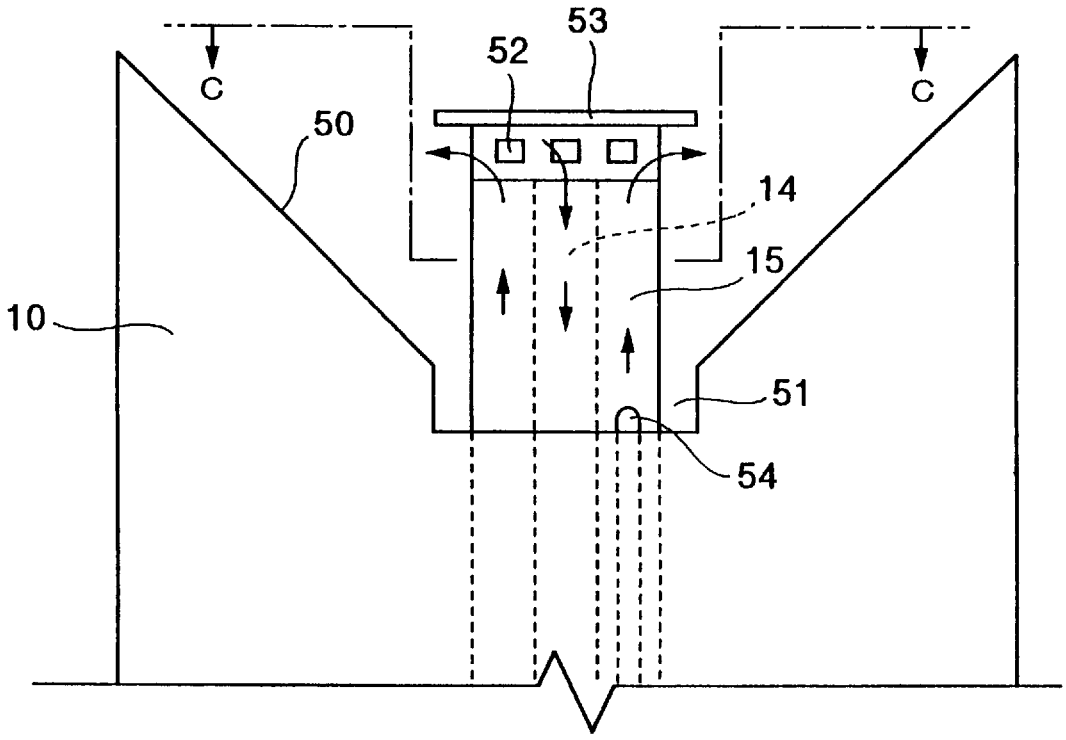
FIG. 16 is a front view for an eleventh embodiment of the present invention showing a roof section of the building.
Figure 17:
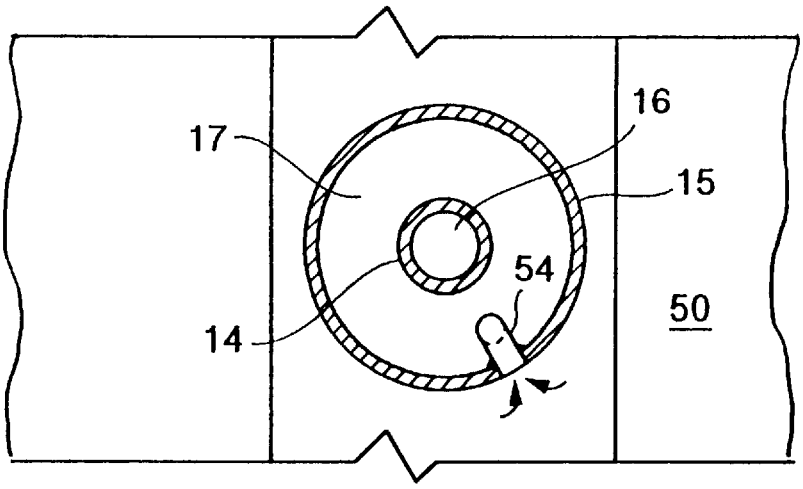
FIG. 17 is a cross-sectional view taken along line C of FIG. 16.

FIG. 16 and FIG. 17 show an eleventh embodiment of the present invention. In this embodiment, roof surface 50 of building 10 has a V-shaped form. Water gathering section 51 is formed at the central portion. On the top of air supply/exhaust cylinders 14 and 15, constituting a double cylinder, aeration cover 53, with aeration openings 52 on the peripheral surface, is set.

Drainage pipe 54 is located in air supply path 16. An upper edge of drainage pipe 54 extends through air exhaust cylinder 15 and opens into water gathering section 51. When it rains, rain water is gathered in water gathering section 51 and flows down through drainage pipe 54.

It should be noted that, in this embodiment, when the rain water flows through drainage pipe 54, the temperature in air supply path 16. The difference between $T_d$ and $T_u$ in the expression (4) becomes larger, and, thus, aeration is promoted. For this reason, a large draft can always be obtained. In each of the embodiments described above, it is possible to accommodate, in air supply path 16, a cooling pipe for water, gas a cooling medium or the like in air supply path 16. It is also possible to accommodate, in air exhaust path 17, a heating pipe for warming, a pipe for hot water supply, or a pipe for central hot water. In addition, because roof surface 50 has a V-shaped form, it is wind resistant, and, therefore, prevents air turbulence around aeration opening 52, obtaining good aeration.

In each of the embodiments described above in which air supply/exhaust cylinders comprise a double cylinder, the internal cylinder functions as an air supply cylinder and the external cylinder functions as an air exhaust cylinder. It should be apparent to those of skill in this art that the internal cylinder may also function as an air exhaust cylinder and the external cylinder as an air supply cylinder.

As described above, with the present invention, it is possible to save energy required for aeration and ventilation. The functions for aeration and ventilation are not lost even if the power to them goes down in a disaster. Further, the air supply path and components thereof can be used for various purposes.

What is claimed:

1. An aeration system for a multi-storied building wherein said multi-storied building provides at least one living space located on each floor of said multi-storied building; said aeration system comprising in each living space an air supply hole for letting in outdoor air located in a lower section of said living space and an air exhaust hole located in an upper section of said living space; an air supply path connected to each air supply hole and an air exhaust path connected to each exhaust hole in each living space; wherein said air supply path and said air exhaust path each extend vertically through each floor of said multi-storied building; wherein an air exhaust fan is located at an exit section of said air exhaust path; wherein said air supply path and said air exhaust path are arranged in a double conduit consisting of an internal conduit inside an external conduit; wherein a span member is located between said external conduit and a pole in said building frame, wherein a water gathering section for gathering rain therein is formed in a roof section of said building frame; said internal and external cylinders project into said water gathering section, and a drainage pipe for rain water opens into said water gathering section is located in said air exhaust path.

2. An aeration system for a multi-storied building having at least one living space located on each floor; comprising in each living space an air supply hole for letting in outdoor air located in a lower section of said living space and an air exhaust hole located in an upper section of said living space; an air supply path connected to each air supply hole and an air exhaust path connected to each air exhaust hole in each living space; wherein said air supply path and said air exhaust path each extends vertically through each floor of said building; wherein said air exhaust path contains a plurality of warm fluid pipes; where said warm fluid pipes carry warm fluid with a temperature greater than the ambient air temperature in said air exhaust path; wherein said air supply path contains a plurality of cold fluid pipes, wherein said cold fluid pipes carry cold fluid with a temperature less than the ambient air temperature in said air supply path.

3. The aeration system of claim 2, wherein said warm fluid is supplied from the hot water supply of said multi-storied building.

4. The aeration system of claim 2, wherein said cold fluid is supplied from the rain water drainage system for said multi-storied building.

5. The aeration system of claim 2, wherein said cold fluid is supplied from the chilled water supply for said multi-storied building.

6. The aeration system of claim 2, wherein the air inside said air exhaust path is in heat transfer communication with the fluid inside said warm fluid pipes.

7. The aeration system of claim 2, wherein the air inside said air supply path is in heat transfer communication with the fluid inside said cold fluid pipes.

8. The aeration system of claim 2; wherein said air supply path and said air exhaust path are arranged in a double conduit consisting of an internal conduit inside an external conduit.

* * * * *